US005361917A

United States Patent [19]

Mautino et al.

[11] Patent Number: 5,361,917

[45] Date of Patent: Nov. 8, 1994

[54] DRAWBAR BEARING BLOCK

[75] Inventors: Peter S. Mautino, Verona; Douglas M. Hanes, Pittsburgh, both of Pa.

[73] Assignee: McConway & Torley Corporation, Pittsburgh, Pa.

[21] Appl. No.: 142,576

[22] Filed: Oct. 25, 1993

[51] Int. Cl.[5] ..... B61G 9/00

[52] U.S. Cl. ..... 213/50; 213/62 R; 384/212; 403/57; 403/311

[58] Field of Search ..... 213/62 R, 50, 56, 50.5, 213/62 A, 57, 61, 51, 60, 12; 403/57, 310, 311, 313; 384/192, 206, 209, 210, 212, 211

[56] References Cited

U.S. PATENT DOCUMENTS

| | | | |
|---|---|---|---|
| 4,422,557 | 12/1983 | Altherr | 213/62 R |
| 4,456,133 | 6/1984 | Altherr et al. | 213/69 |
| 4,549,666 | 10/1985 | Altherr et al. | 213/69 |
| 4,580,686 | 4/1986 | Elliott | 213/62 A |
| 4,593,827 | 6/1986 | Altherr | 213/62 R |
| 4,681,040 | 7/1987 | Brodeur | 213/62 R |
| 4,863,045 | 9/1989 | Altherr | 213/62 A |
| 4,966,291 | 10/1990 | Glover | 213/62 A |
| 5,002,192 | 3/1991 | Kaufhold | 213/50.5 |
| 5,042,393 | 8/1991 | Kanjo et al. | 213/62 R |
| 5,097,973 | 3/1992 | Spencer | 213/50 |
| 5,190,173 | 3/1993 | Mautino et al. | 213/62 R |
| 5,193,699 | 3/1993 | Kaufhold et al. | 213/62 R |
| 5,207,718 | 5/1993 | Glover et al. | 213/62 R |

FOREIGN PATENT DOCUMENTS

| | | | |
|---|---|---|---|
| 0594689 | 5/1959 | Italy | 213/61 |

*Primary Examiner*—Mark T. Le
*Attorney, Agent, or Firm*—James Ray & Associates

[57] ABSTRACT

A drawbar bearing block for a slackless drawbar system which connects adjacent ends of a pair of railway cars in a semi-permanent manner. Such bearing block includes a top portion supported and retained in a hemispherical recess which extends partially around a pin opening formed in a pin receiving opening disposed in a butt end of a drawbar. Such top portion of the bearing block has an outer surface which closely matches a surface of such hemispherical recess and an inner surface having a cylindrical shape to receive a pin therein. There is at least one recessed opening formed in the top portion adjacent a bottom surface and an outer surface thereof. A bottom portion is supported and retained in such hemispherical recess and assists in supporting and retaining such top portion in the hemispherical recess. Such bottom portion of the bearing block includes an outer surface which closely matches the surface of such hemispherical recess and an inner surface having a cylindrical shape to receive a pin therein. Such inner surface being in alignment with such inner surface of such top portion. There is at least one tab-like member extending upwardly from an upper surface of such bottom portion and adjacent said outer surface thereof. Such tab-like member matingly engages with the recess in said top portion. Such tab-like member has an outer surface which closely matches the surface of such hemispherical surface.

12 Claims, 8 Drawing Sheets

DRAWBAR BEARING BLOCK

FIELD OF THE INVENTION

The present invention relates, in general, to drawbars utilized in slackless drawbar systems which have fixed pivot pins and, more particularly, this invention relates to an improved drawbar bearing block which will be described and illustrated in a railway application as a component for a railway car slackless drawbar system.

BACKGROUND OF THE INVENTION

In this application, slackless drawbars are most commonly used to connect, in a substantially semi-permanent manner, adjacent ends of a pair of railway cars used in dedicated service. For example, these railway cars may be used in coal or ore operations or in cargo container service. In these particular applications it is not necessary to provide standard Association of American Railroads (AAR) couplers and/or draft gear arrangements since the railway cars are only rarely uncoupled. Nevertheless, it is still desirable to avoid unnecessary impact due to the take-up of slack which can cause rather severe damage to both equipment and/or lading.

The avoidance of shock loads caused by the take-up of such slack between cooperating elements of a railway car coupling system, through which draft and buff loads are applied to a train, has long been a major concern of railway operators. It is recognized in the railroad industry that in some dedicated train operations it is advantageous to avoid the excess weight and cost associated with standard AAR couplers and draft gear arrangements by replacing them with lighter weight, simple drawbars. This means, however, that slack take-up and impact dissipation systems included in the deleted equipment are also eliminated. Therefore, it has been the goal in designing drawbar systems to eliminate as much slack as possible. It is also desirable to keep the apparatus light in weight, strong enough to withstand maximum draft and buff loads and flexible enough to handle side to side and fore and aft angling as required by AAR rules.

It is well known that slackless drawbar systems have been used in the railway industry prior to the present invention. For example, U.S. Pat. No. 4,580,686 illustrates one such system having a wedge-shaped slack take-up member and U.S. Pat. No. 4,996,291 shows a slackless rotary drawbar system. The disclosures of the above patents are incorporated herein by reference and made a part of this disclosure.

SUMMARY OF THE INVENTION

This invention provides improvements over U.S. Pat. No. 5,207,718 which is commonly owned by the assignee of the present invention. The present invention provides an improved bearing block assembly for use in the drawbar portion of a slackless drawbar system. The drawbar is comprised of an elongated bar having a butt end portion, a load support portion, a pin receiving opening, which extends through the load support portion, a hemispherical recess which extends partially around the pin receiving opening. The improved drawbar pin bearing or bearing block of the present invention is supported and retained in the hemispherical recess disposed in the butt end of the drawbar. Such bearing block is retained in the hemispherical recess by a retaining clip. The butt end of the drawbar engages a follower member which, in turn, is in contact with a slack take-up wedge that holds the follower member in close contact with the butt end of the drawbar. A draft stop or other connecting element provides a final connection between the slack take-up wedge and the center sill of a railway car to handle buff forces. Further, the improved drawbar pin bearing block of the present invention has an outer surface which closely matches the hemispherical recess in the pin receiving opening in the drawbar, while the pin bearing's inner surface has a cylindrical shape to pivotally receive a pin which connects the drawbar through a suitable yoke or other connecting element to the center sill of a railway car to apply draft forces thereto. The improved pin bearing block of the present invention is comprised of a top portion and a bottom portion. The bearing block, when assembled for use in the drawbar, is retained in the hemispherical recess of the drawbar by a retaining clip. The retaining clip is received in a retaining clip recess which extends around the portion of the pin receiving opening which is not occupied by the hemispherical recess. In essence, the retaining clip recess holds the retaining clip in position to contact the pin bearing block and help hold it in proper position to receive the pin. It has been found that the drawbar will have improved stress handling characteristics if the hemispherical recess for the bearing block is extended over an arc of at least about 180°. This invention provides a drawbar system which avoids shocks and excess loads caused by slack, yet it is lighter in weight and is capable of handling the same maximum draft and buff loads as previously known drawbar systems.

OBJECTS OF THE INVENTION

It is, therefore, one of the primary objects of the present invention to provide an improved drawbar bearing block for use in a slackless drawbar system that can be readily applied to a standard railway car with a minimum amount of modification of the drawbar itself or to the center sill member disposed on the railway car.

Another object of the present invention is to provide a slackless drawbar system which offers a substantial reduction in weight over conventional drawbars presently used in standard AAR coupler and draft gear systems.

A further object of the present invention is to provide a slackless drawbar system which requires a minimum amount of maintenance.

It is also an object of the present invention to provide an improved bearing block for use in a slackless drawbar system which avoids slack in both draft and buff modes.

Still another object of the present invention is to provide an improved bearing block for use in a drawbar to be incorporated into a slackless drawbar system which has been designed to avoid high stress concentrations and to resist wear in high wear areas thereby providing reliability and long service life.

Yet another object of the present invention is to provide an improved bearing block which can be used in a drawbar used as a transition member to connect, in a substantially semi-permanent manner, adjacent ends of two railway cars equipped with different types of coupling systems.

In addition to the objects and advantages of the invention described above, various other objects and advantages of this invention will become more readily apparent to persons skilled in the railway coupling art from the following more detailed description of the invention, particularly when such description is taken in conjunction with the attached drawings and with the appended claims.

DESCRIPTION OF THE PREFERRED EMBODIMENTS

Figure 1:
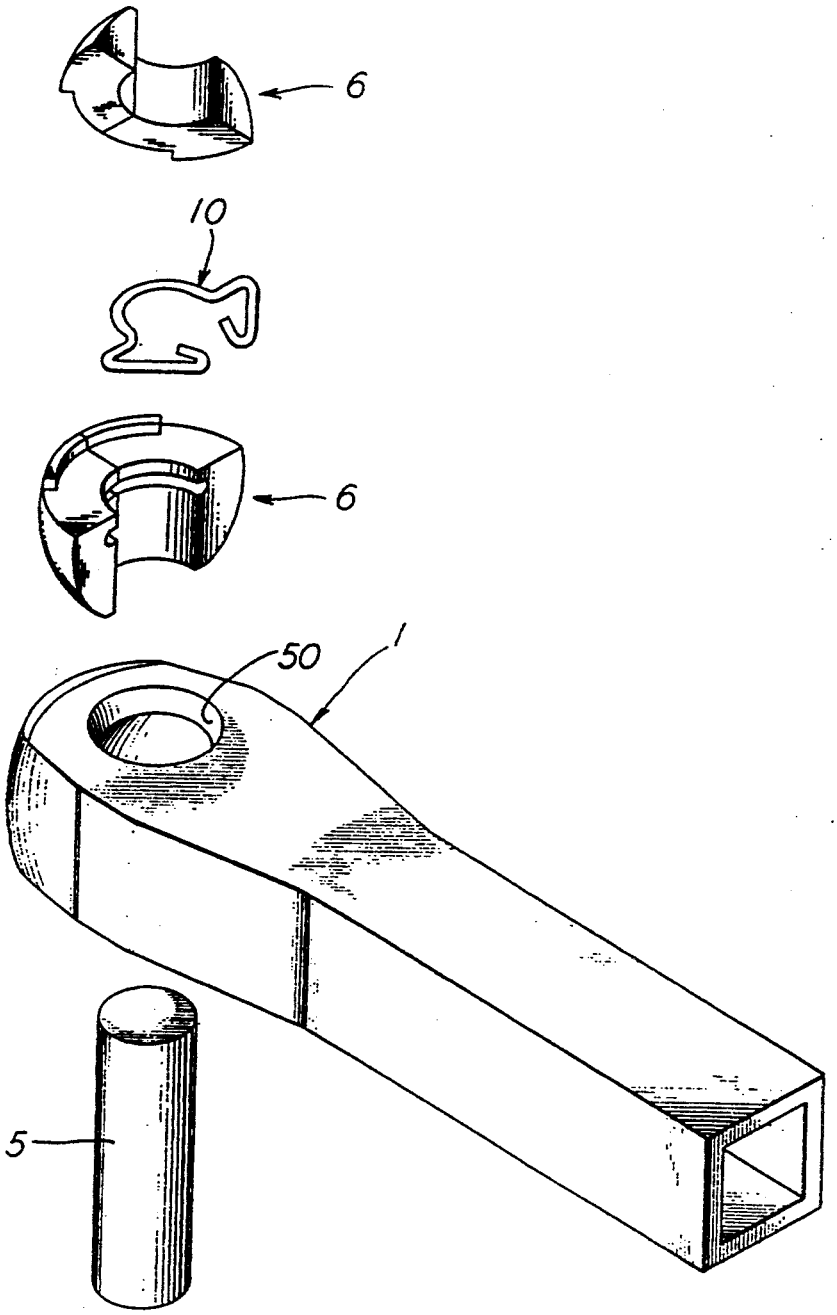
FIG. 1 is an exploded view of the elements of a slackless drawbar including the improved bearing block constructed in accordance with the present invention.

Prior to proceeding to the more detailed description of the present invention, it should be noted that throughout the numerous views, illustrated in the drawings, identical components, having identical functions, have been identified with identical reference numerals for the sack of clarity.

Figure 3:
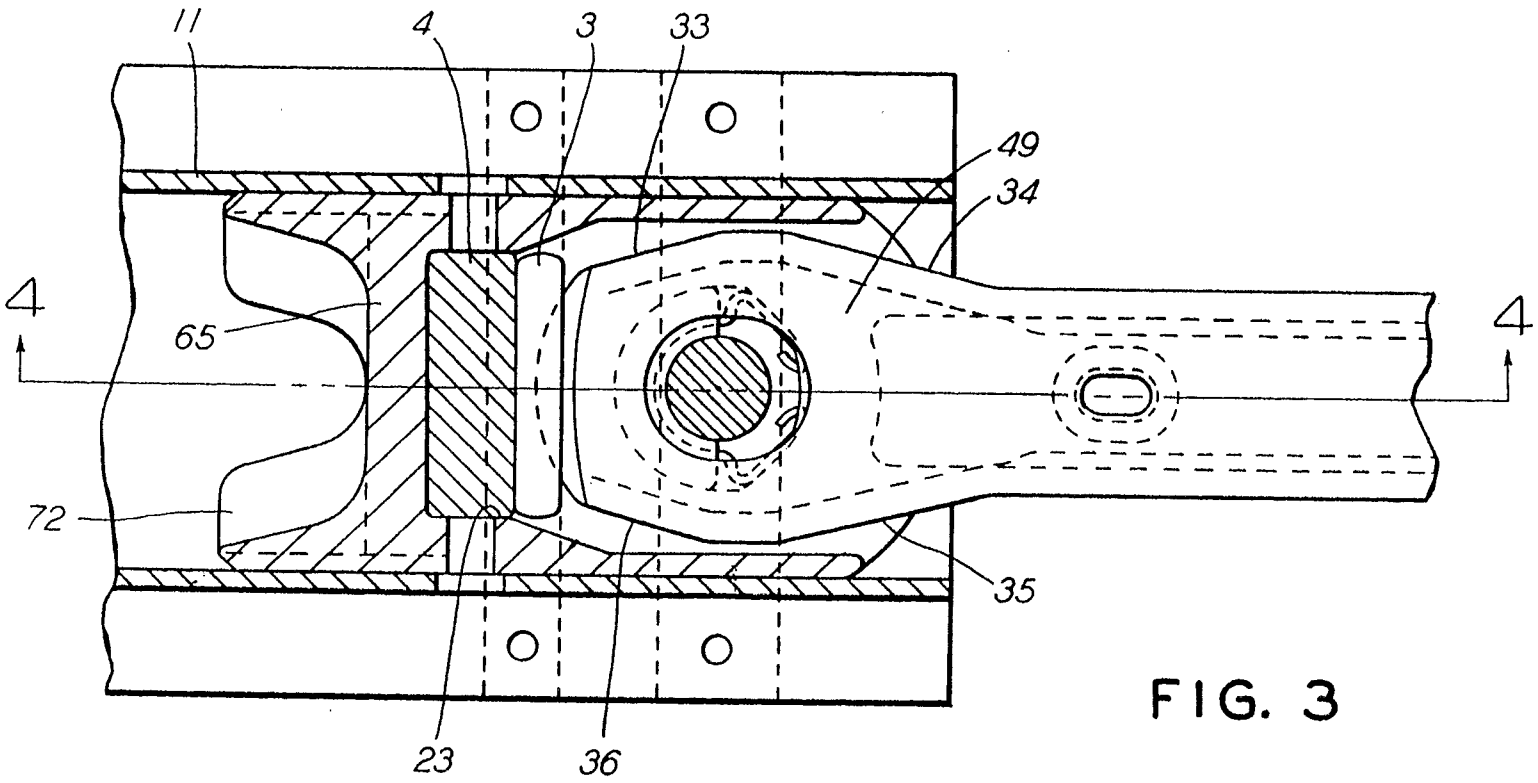
FIG. 3 is a partial cross-sectional view of the drawbar illustrated in FIG. 2 taken along the lines III—III in FIG. 4.
Figure 4:
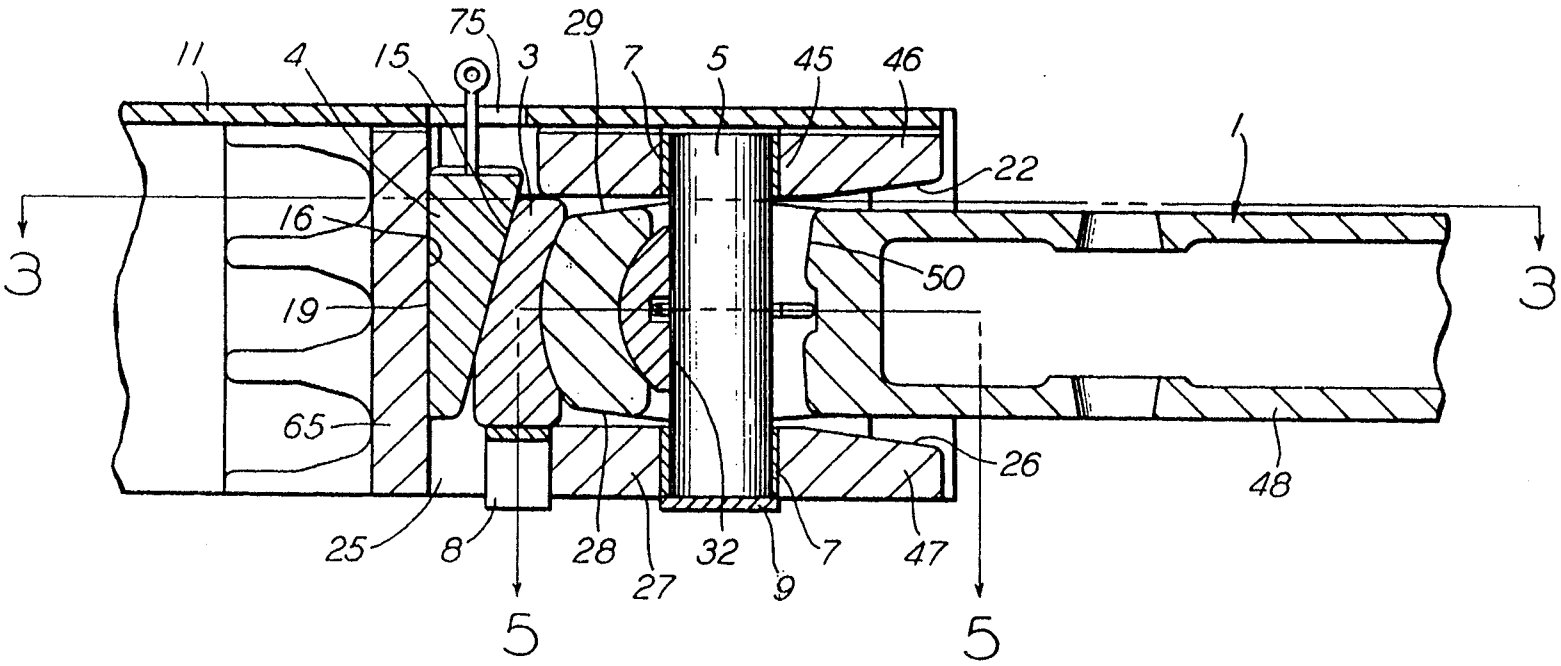
FIG. 4 is a cross-sectional view of the drawbar illustrated in FIG. 2 taken along the lines IV—IV in FIG. 3.
Figure 5:
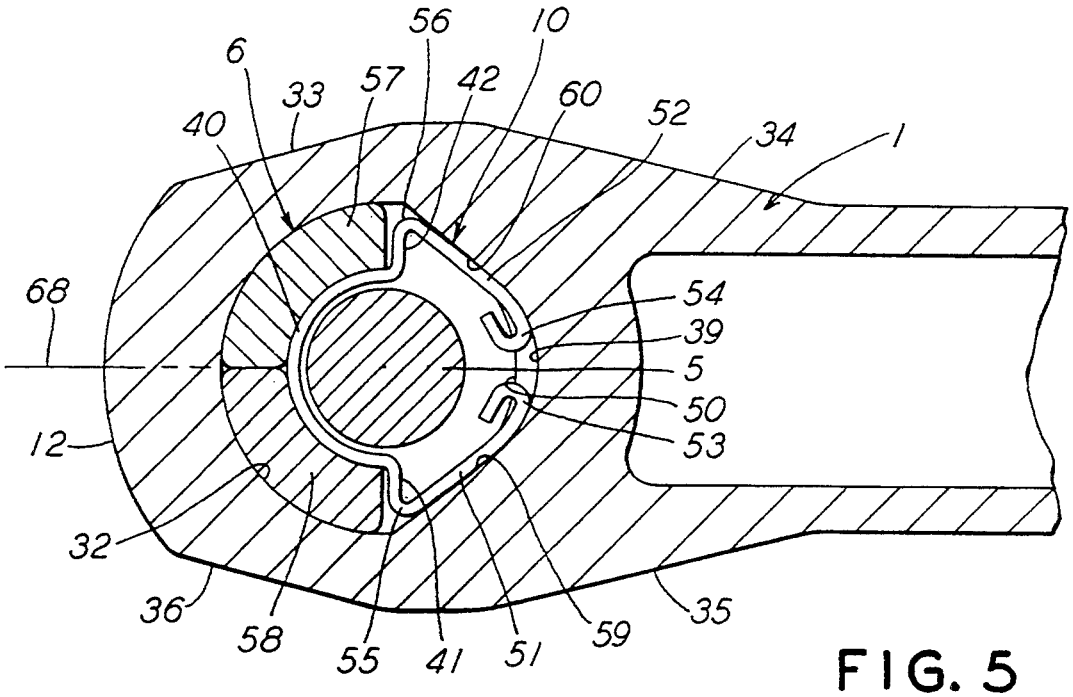
FIG. 5 is a detailed cross-sectional view of the end of a drawbar taken along the lines V—V in FIG. 4 and illustrating the bearing block shown in U.S. Pat. No. 5,207,718.
Figure 6:
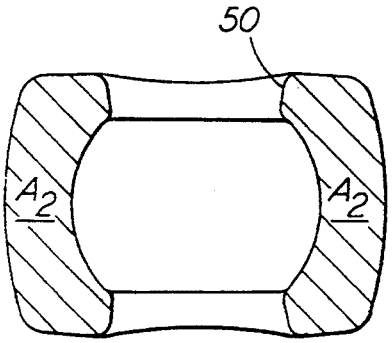
FIG. 6 is a view taken along lines VI—VI in FIG. 2 showing the cross-sectional area of the drawbar adjacent the opening for the pin and which receives the improved bearing block of the present invention.
Figure 7:
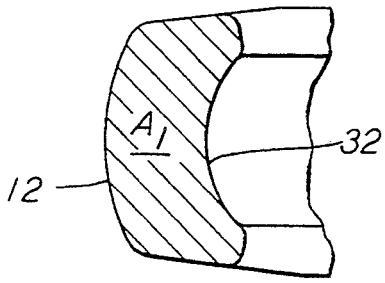
FIG. 7 is a view taken along lines VII—VII in FIG. 2 showing the cross-sectional area of the drawbar adjacent the opening for the pin and which receives the improved bearing block of the present invention.

As can best be seen in FIGS. 3 and 4 of the drawings, the slackless drawbar, generally designated, 1 is connected to a yoke (not shown) or other connecting element, generally designated, 2. Connecting element 2, in turn, is fastened to the center sill 11 of a railway car (not shown). The butt or inner end 12 (FIG. 5) of drawbar 1 is in contact with a follower member 3. Such follower member 3 is held in close contact with the butt end 12 of the drawbar 1 by a slack take-up wedge 4. Slack take-up wedge 4 is held in its position along the railway car center sill 11 by member 65 which preferably is the back wall of connecting element 2 or some other form of draft stop (not shown) rigidly secured to the center sill 11. Buff forces are applied from a railway car to the slackless drawbar 1 through the connecting element 2, slack take-up wedge 4 and follower member 3 to the butt end 12 of the drawbar 1. Follower member 3 and slack take-up wedge 4 have cooperating oppositely inclined faces 15 and 16, respectively, which allow the slack take-up wedge 4 to drop by gravity to compensate for slack in the drawbar system. Slack in the drawbar system can occur, for example, due to wear of the various components. The angle of the inclined faces 15 and 16 is selected to permit easy downward movement of the slack take-up wedge 4 by gravity but to inhibit upward motion particularly under buff loads. This angle is approximately 14°. The slack take-up wedge 4, follower member 3 and support casting or connecting element 2 are constructed and arranged so that about one inch of slack can be compensated for without detrimental effect on the load carrying capabilities of the drawbar system. When this slack limit is reached, the slack take-up wedge 4 can be removed and replaced with another slack take-up wedge of the same configuration. However, it should be understood that the thickness of the new slack take-up wedge, at any given point between the inclined face 16 and the vertical face 19, will be greater than the corresponding thickness of the slack take-up wedge 4 being replaced. The bearing block, generally designated, 6 is held in position within the slackless drawbar 1 by a retaining clip, generally designated, 10. As can best be seen in FIGS. 1, 3, 12 and 15 of the drawings, the inner surface 43 of improved drawbar 1 bearing block 6 has an arcuate groove 38 formed in the bottom portion thereof. When the bottom portion of the improved drawbar 1 bearing block 6 is in position within drawbar 1, arcuate groove 38 is in registry with a groove or recess 39 (FIG. 5) which extends around the circumferential portion of the inner surface of opening 50 not occupied by annular recess 32 formed in drawbar 1. Bearing block 6 can more easily be inserted in the opening 50 when it is made in two parts. According to the present invention improved bearing block 6 includes a top portion, generally designated, 200 and a bottom portion, generally designated, 210.

Retaining clip 10 is preferably made of wire spring material and is generally symmetrical. As clearly seen in FIGS. 1, 3 and 5, the retaining clip 10 has a semicircular bight portion 40, diverging offset portions 41 and 42 providing shoulders which help hold the bottom portion 210 of bearing block 6 in a position substantially centered in the recess 32, rectilinear portions 51 and 52 which are connected by relatively sharp bends 55 and 56, respectively, to the offset portions 41 and 42 and impinge against complementary rectilinear portions 59 and 60 of the groove thereby creating a spring bias urging the bottom portion 210 of bearing block 6 into position against recess 32. Finally, retaining clip 10 includes sharply bent end portions 53 and 54 which provide means for engaging the retaining clip 10 for compression and removal and prevent binding of retaining clip 10 in the groove 39 formed in the drawbar 1. The slackless drawbar assembly is attached to the car preferably by welding or otherwise attaching connecting element 2 to the center sill of the car.

As best seen in FIG. 4, inclined surfaces 28 and 29 are provided at the bottom and top, respectively, of the inner end 12 of the slackless drawbar 1 to permit rocking of the end of the drawbar 1 about a horizontal axis within the connecting member 2.

Inclined surfaces 33, 34, 35 and 36, as illustrated in FIG. 3, are provided at the load support portion 49 of the slackless drawbar 1 to permit relative swinging motion about pin 5 when a railway car to which the slackless drawbar 1 is attached negotiates a curve.

The portion 48 (FIG. 4) of the slackless drawbar 1 intermediate its ends is preferably tubular to substantially reduce the weight while the load support portion and butt ends are normally of solid material. The load support portion 49 of the slackless drawbar 1 has an opening 50 extending therethrough of a diameter larger than pin 5. Opening 50 is generally elliptical in horizontal cross-section and has an annular recess 39 extending around approximately one-half the circumference of opening 50 nearest the butt end 12 of the slackless drawbar 1. This annular recess 39 is shaped and sized to receive the outer spherical surface 37 of bearing block 6. The opening 50 of the slackless drawbar 1 is flared adjacent its ends to permit rocking motion of slackless drawbar 1 with respect to the vertical axis of pin 5.

It is understood that a transition or interconnection drawbar can be made which has one end constructed and arranged to be connected to a railway car fitted with slackless draft systems of the type illustrated herein and its other end constructed and arranged for connection to a railway car fitted with a different form of draft systems (not shown) such as a standard AAR coupler and draft gear or a rotary type coupling which allows side dumping of a railway car. Such a drawbar would allow a semi-permanently coupled set of cars to be inserted in a train with conventional coupling or with cars designed for rotary dumping.

The slackless drawbar 1 of this invention was designed and constructed to produce superior performance and results under load conditions required by AAR for standard couplers so that the improved drawbar can be used in a train with conventionally coupled cars. Therefore stress analysis was made with draft loads of at least about 900,000 lbs. and buff loads of at least about 1,250,000 lbs. Complete stress analysis of the drawbar were done using a system of analysis known as Finite Element Analysis (FEA).

Materials for the slackless drawbar and related components were selected to provide the best results based on the forces to be withstood, type of use and exposure to wear. Weight is important in railway and other transportation applications and efforts were made to keep weight at a minimum consistent with the need to meet strength and wear requirements.

In the preferred embodiment the slackless drawbar 1 is made of AAR Grade "E" steel and has a weight of about 690 lbs. The follower and wedge are also made of AAR Grade "E" steel and weigh about 45 lbs. and 49 lbs., respectively. The pin 5 can be a 3½ inch diameter AISI 1080 or AISI 8620 steel pin weighing about 33 lbs.

The follower member 3 and butt end 12 of the drawbar 1 will be subject to high wear. These areas are preferably flame hardened to provide better wear characteristics. The improved drawbar 1 bearing block 6 is preferably constructed in two pieces consisting of the top portion 200 and bottom portion 210 manufactured from a high compressive wear resistant material such as Austempered Ductile Iron. This material is known to have high compressive strength, but retains ductility and has a relatively short wear-in period while retaining long overall wear-life. The improved bearing block 6 weighs a total of about 11 lbs. The retaining clip 10 is preferably made of corrosion resistant spring wire material such as ASTM 302 stainless steel.

The design of the improved bearing block 6 and the opening 50 in the drawbar are critical to produce stress and wear characteristics desired.

Looking at FIGS. 1, 2, 3, 5 and 6, it can be seen that opening 50 is of generally elliptical shape in cross-section transverse to its longitudinal axis and has a generally hemispherical recess 32 for receiving the complementary hemispherical outer surface of bearing block 6. Recess 32 is located in the portion of opening 50 closest to butt end 12 of the slackless drawbar 1. Recess 32 is symmetrically positioned with respect to the longitudinal axis 68 of the slackless drawbar 1 and extends circumferentially more than 90° on either side of axis 68 terminating at points 69 and 70 at the deepest part of recess 32 and at slope transition points 71 and 72 at its intersection with the wall of opening 50. The location of these transition points is important to avoid high stress concentration which could cause failure of the slackless drawbar 1.

Figure 14:
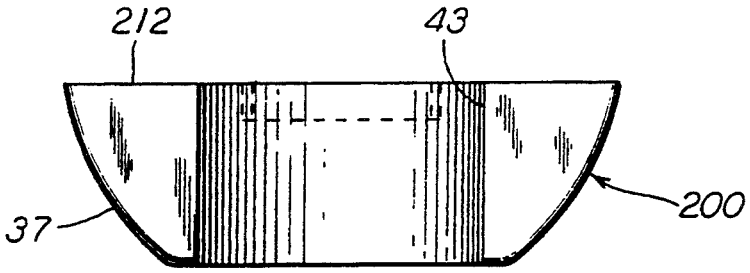
FIG. 14 is a front view of the top portion of the improved bearing block constructed according to the present invention.
Figure 15:
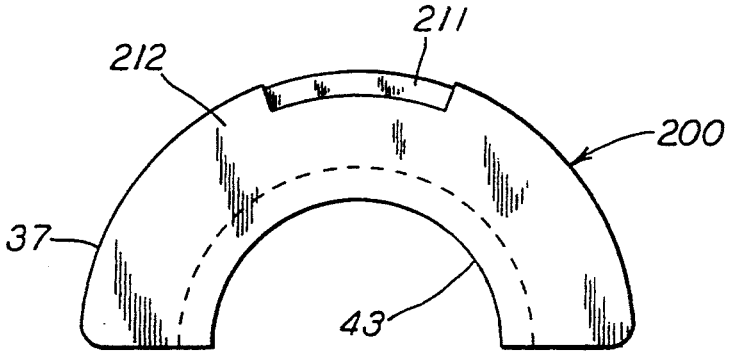
FIG. 15 is a top view of the improved bearing block illustrated in FIG. 14.
Figure 16:
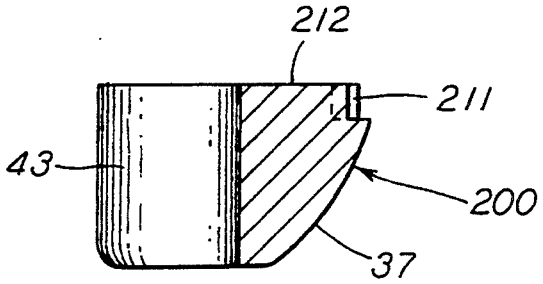
FIG. 16 is a side elevational view of the improved bearing block illustrated in FIG. 14.

In the presently preferred embodiment of the inventions the drawbar 1 bearing block 6 is formed in two pieces. As best seen in FIGS. 14, 15 and 16, such drawbar 1 bearing block 6 includes a top portion, generally designated, 200 which is supported and retained in the hemispherical recess 32. Hemispherical recess 32 is formed in opening 50 of butt end 12 of the drawbar 1. Such hemispherical recess 32 extends partially around a pin opening formed in a pin receiving opening. The top portion 200 of bearing block 6 has an outer surface 37 which closely matches the surface of such hemispherical recess 32. The inner surface 43 of the top portion 200 has a cylindrical shape to receive in abutting engagement therein the pin 5. There is at least one recessed opening 211 formed adjacent a bottom surface 212 and the outer surface 37 thereof.

Figure 11:
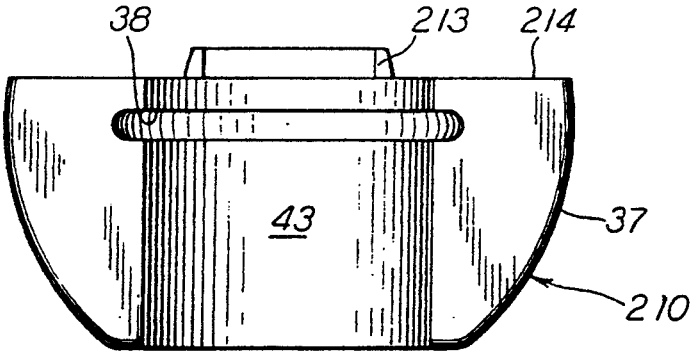
FIG. 11 is a front view of the bottom portion of the improved bearing block of the present invention.
Figure 12:
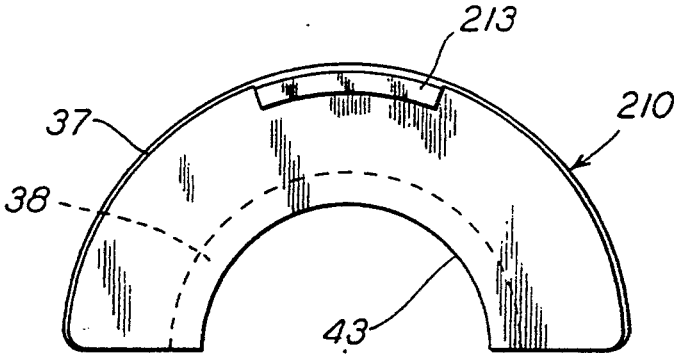
FIG. 12 is a top view of the improved bearing block illustrated in FIG. 11.
Figure 13:
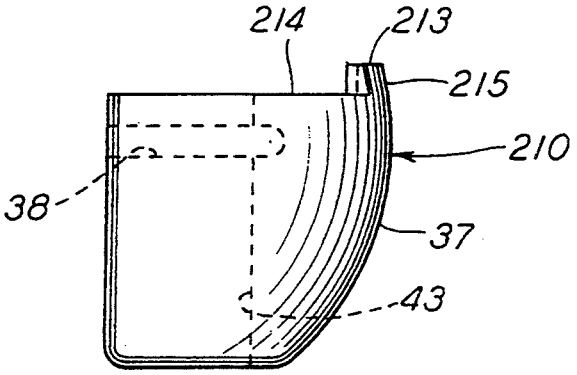
FIG. 13 is a side elevational view of the improved bearing block illustrated in FIG. 11.

As best seen in FIGS. 11, 12 and 13, there is a bottom portion, generally designated, 210 of bearing block 6 which is also supported and retained in such hemispherical recess 32. The bottom portion 210 of bearing block 6 assists in supporting and retaining the top portion 200 in such hemispherical recess 32. The outer surface 37 of the bottom portion 210 also closely matches the surface of such hemispherical recess 32. Likewise, the inner surface 43 of the bottom portion 210 has a cylindrical shape to receive another portion of the pin 5 therein. It is important that the inner surface of the bottom portion 210 and the top portion 200 of bearing block 6 to be substantially in alignment. There is at least one tab-like member 213 which extends upwardly from the upper surface 214 of such bottom portion 210 adjacent the outer surface 37 thereof. Such tab-like member 213 matingly engages with the recessed portion 211 formed in the top portion 200. Tab-like member 213 includes an outer surface 215 which closely matches the surface of hemispherical recess 32. It can be seen that the bearing block 6 is constructed such that the bottom portion 210 is retained in annular recess 32 by the retaining clip 10.

Figure 10:
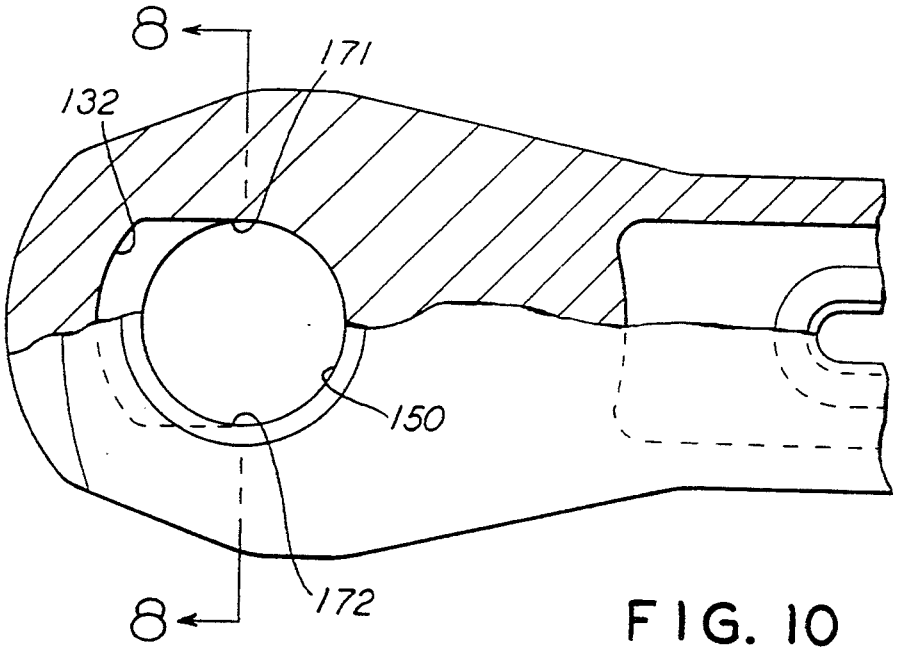
FIGS. 8, 9 and 10 are views of a prior art drawbar comparable, respectively, to the views of the invention shown in FIG. 6, 7 and 2.
Figure 2:
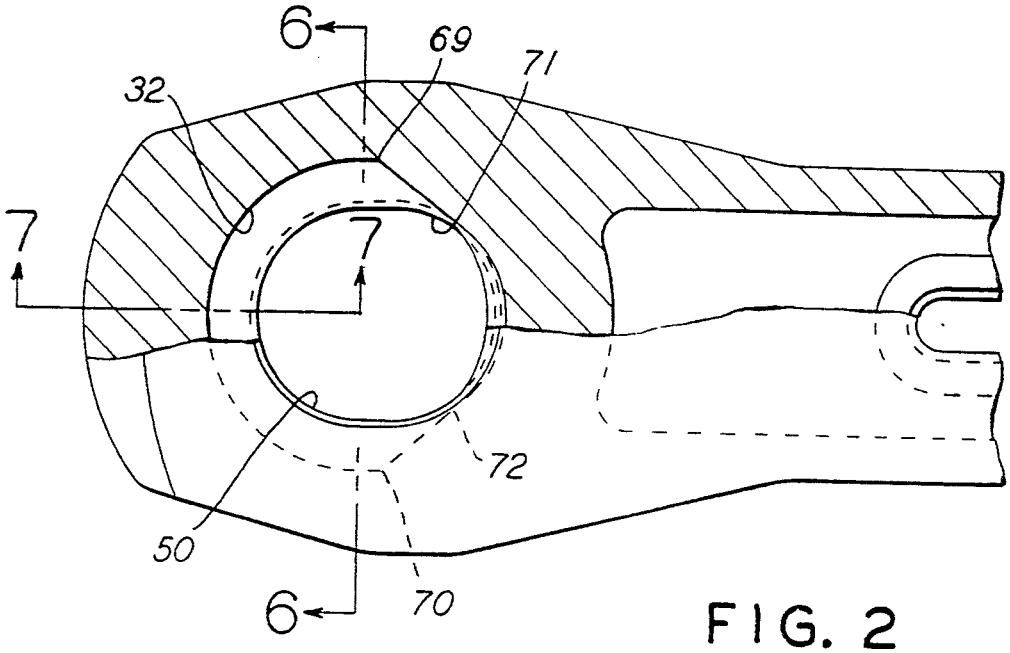
FIG. 2 is a detailed plan view, partly in cross-section of one end of a drawbar which can be used with the improved bearing block of this invention.

Turning to FIG. 10, which shows an earlier drawbar system design with a substantially circular opening 150 for the pin and a recess 132 for a bearing block, it can be seen that slope transition points 171 and 172 will occur at a point toward the butt end of the drawbar from the center of opening 150. Stress analysis of such a drawbar showed high stress concentration under load at the slope transition points 171 and 172 which could cause fatigue failure of the drawbar. In the preferred embodiment of the present invention, the degree of change of slope at the slope transition point is substantially reduced and the transition point is moved to a less critical area on the side of the center of opening 50 toward intermediate portion 48 of the drawbar and stress concentration at slope transition points 71 and 72 is virtually eliminated.

Figure 8:
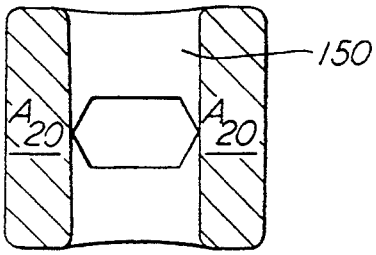
Figure 9:
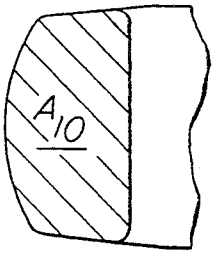

FIGS. 6, 7, 8 and 9 show a comparison of the cross-sectional areas of the butt end and walls of a drawbar adjacent the opening for the pin 5 for a drawbar 1 constructed according to the invention (FIGS. 6 and 7) and a prior art "F" type coupler (FIGS. 8 and 9). The area A1 at the butt end of the drawbar disclosed herein is about 19.10 square inches compared to area A10 of the prior art design of about 19.7 square inches. The combined areas of the cross-sections A2 adjacent the pin hole or opening 50 of the invention total about 30.00 square inches compared to the combined areas A20 of the prior art design of about 24.02 square inches.

The above characteristics of the drawbar, the use of the bearing block and the selection of material and heat treating procedures all cooperate to provide a greatly improved and advantageous drawbar for a slackless drawbar system.

While the present invention has been described and shown in connection with preferred embodiments, it is apparent that other embodiments may be derived and modifications or changes may be made to the invention as shown and described herein, therefore, the scope of the invention should be construed and limited only in accordance with the appended claims.

We claim:

1. An apparatus including an improved drawbar bearing block for a slackless drawbar system which connects adjacent ends of a pair of adjacent railway cars in a semi-permanent manner, said improved drawbar bearing block comprising:

(a) a top portion supported and retained in a hemispherical recess which extends partially around a pin opening formed in a pin receiving opening formed in a butt end of a drawbar, said top portion of said improved bearing block including;
  (i) an outer surface which closely matches a surface of said hemispherical recess,
  (ii) an inner surface having a cylindrical shape to receive a pin therein, and
  (iii) at least one recessed opening formed adjacent a bottom surface and an outer surface of said top portion; and (b) a bottom portion supported and retained in said hemispherical recess and which assists in supporting and retaining said top portion in said hemispherical recess, said bottom portion of said improved bearing block including;
  (i) an outer surface which closely matches a surface of said hemispherical recess,
  (ii) an inner surface having a cylindrical shape to receive a pin therein and in alignment with said inner surface of said top portion, and
  (iii) at least one tab-like member extending upwardly from an upper surface of said bottom portion and adjacent said outer surface of said bottom portion, said tab-like member matingly engaging with said recess opening in said top portion, said tap-like member has an outer surface which closely matches said surface of said hemispherical recess.

2. An apparatus, according to claim 1, wherein said bottom portion of said bearing block further includes a horizontally disposed groove formed in said inner surface.

3. An apparatus, according to claim 2, wherein said bottom portion of said bearing block further includes a retaining clip disposed in said groove.

4. An apparatus, according to claim 3, wherein said horizontally disposed groove and said retaining clip are substantially arranged symmetrically about a longitudinal axis of said pin.

5. An apparatus, according to claim 1, wherein said improved drawbar bearing block is manufactured from a material that provides sufficient ductility to provide a wear-in period of relatively short duration and is sufficiently hard to provide a relatively high compression strength for increased service life under loading.

6. An apparatus including an improved drawbar bearing block for a slackless drawbar system which connects adjacent ends of a pair of adjacent railway cars in a semi-permanent manner, said improved drawbar bearing block comprising:

(a) a top portion supported and retained in a hemispherical recess which extends partially around a pin opening formed in a pin receiving opening formed in a butt end of a drawbar, said top portion of said improved bearing block including;
  (i) an outer surface which closely matches a surface of said hemispherical recess,
  (ii) an inner surface having a cylindrical shape to receive a pin therein, and
  (iii) at least one tab-like member extending downwardly from a bottom surface of said top portion and adjacent said outer surface of said top portion, said tab-like member has an outer surface which closely matches said surface of said hemispherical recess; and (b) a bottom portion supported and retained in said hemispherical recess and which assists in supporting and retaining said top portion in said hemispherical recess, said bottom portion of said improved bearing block including;
  (i) an outer surface which closely matches a surface of said hemispherical recess,
  (ii) an inner surface having a cylindrical shape to receive a pin therein and in alignment with said inner surface of said top portion, and
  (iii) at least one recessed opening formed adjacent an upper surface of said bottom portion and adjacent said outer surface of said bottom portion, said recessed opening matingly engages with said tab-like member in said top portion.

7. An apparatus, according to claim 6, wherein said horizontally disposed groove and said retaining clip are substantially arranged symmetrically about a longitudinal axis of said pin.

8. An apparatus, according to claim 6, wherein said improved drawbar bearing block is manufactured from a material that provides sufficient ductility to provide a wear-in period of relatively short duration and is sufficiently hard to provide a relatively high compression strength for increased service life under loading.

9. An apparatus, according to claim 6, wherein said bottom portion of said bearing block further includes a horizontally disposed groove formed in said inner surface.

10. An apparatus, according to claim 9, wherein said bottom portion of said bearing block further includes a retaining clip disposed in said groove.

11. An apparatus, according to claim 6, wherein said hemispherical recess extends over an arc of at least about 180°.

12. An apparatus, according to claim 6, wherein each of said bottom surface of said top portion and said top surface of said bottom portion lies in a substantially horizontal plane.

* * * * *

UNITED STATES PATENT AND TRADEMARK OFFICE

CERTIFICATE OF CORRECTION

PATENT NO. : 5,361,917

DATED : November 8, 1994

INVENTOR(S) : Peter S. Mautino et al.

Figure 17:
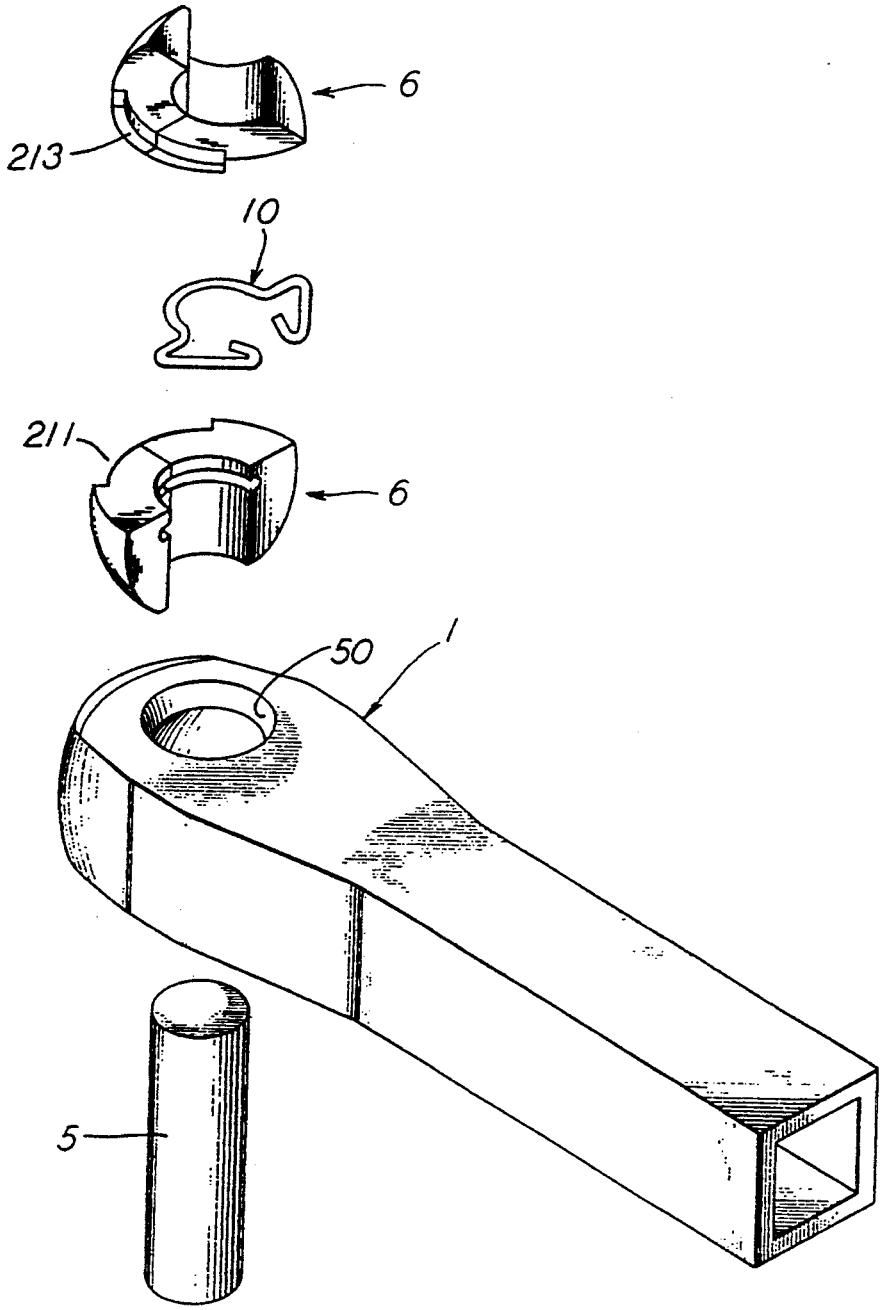

It is certified that error appears in the above-indentified patent and that said Letters Patent is hereby corrected as shown below:

column 3, line 47, please insert --Figure 17 is an exploded view of the elements of a slackless drawbar including the improved bearing block having an alternative configuration.--;

Column 6, line 22, delete "inventions" and insert --invention--;
column 6, line 23, after invention insert --,--;
column 6, line 60, after clip 10., please insert --Figure 17 shows an alternative embodiment of the improved bearing block, wherein the top portion 200 is provided with the tab-like member 213 matingly engaging with the recessed portion 211 provided in the bottom portion 210.--.

Signed and Sealed this

Twenty-eight Day of February, 1995

*Attest:*

Bruce Lehman

BRUCE LEHMAN

*Attesting Officer*

*Commissioner of Patents and Trademarks*